United States Patent [19]

Smith

[11] 4,220,331

[45] Sep. 2, 1980

[54] BASEBALL BATTING RANGE RETRIEVAL SYSTEM

[76] Inventor: Tommy L. Smith, Rte. 3, Box 590, Aurora, Oreg. 97002

[21] Appl. No.: 27,290

[22] Filed: Apr. 5, 1979

[51] Int. Cl.[2] ..... A63B 69/40

[52] U.S. Cl. ..... 273/26 D; 273/201

[58] Field of Search ..... 273/26 R, 29 A, 29 R, 273/30, 26 D, 176 G, 95 H, 176 E, 176 H; 124/10, 78, 47, 48, 49; 272/3

[56] References Cited

U.S. PATENT DOCUMENTS

| | | | |
|---|---|---|---|
| 3,567,223 | 3/1971 | Gentiluomo | 273/201 |
| 3,580,583 | 5/1971 | Gentiluomo | 273/176 G |
| 3,599,978 | 8/1971 | Sondergaard | 273/95 R |
| 3,602,506 | 8/1971 | Gentiluomo | 273/201 |
| 3,682,293 | 8/1972 | Kamp | 198/33 AA |
| 3,766,901 | 10/1973 | Cleary et al. | 273/29 A |
| 3,778,067 | 12/1973 | Gentiluomo | 273/201 |
| 3,948,512 | 4/1976 | Worthington | 273/29 A |
| 4,007,854 | 2/1977 | Ervine | 221/167 |
| 4,025,071 | 5/1977 | Hodges | 273/29 A |
| 4,108,432 | 8/1978 | Clark | 273/29 A |
| 4,126,313 | 11/1978 | Izumi | 273/201 |

*Primary Examiner*—Richard C. Pinkham
*Assistant Examiner*—T. Brown
*Attorney, Agent, or Firm*—Klarquist, Sparkman, Campbell, Leigh, Hall & Whinston

[57] ABSTRACT

A baseball batting range includes a plurality of pitching machines positioned for propelling baseballs toward corresponding batting stations. The range further includes a sloping floor and a sump where the batted baseballs are collected, and a conveyor which delivers the balls from the sump to a distribution hopper elevated with respect to the sump and the pitching machines. Gravity tube magazines fed from the distribution hopper hold a number of baseballs which are metered to the respective pitching machines. The sump and the distribution hopper are provided with agitators facilitating continuous movement of the baseballs.

8 Claims, 6 Drawing Figures

BASEBALL BATTING RANGE RETRIEVAL SYSTEM

BACKGROUND OF THE INVENTION

The present invention relates to a baseball driving range retrieval system, and particularly to such a system wherein baseballs are retrieved continuously and automatically.

Conventional baseball batting ranges comprise no more than a number of pitching machines disposed in line with corresponding batting positions wherein each pitching machine is supplied with a predetermined number of baseballs for which the user pays a given admission fee. Each pitching machine is provided with an individual hopper device into which the baseballs are manually deposited by personnel who retrieve the baseballs. The ground or floor under the batting range may slope toward a central area or a box to which the balls roll for reducing the retrieval distance.

SUMMARY OF THE INVENTION

In accordance with the present invention, a sump located forwardly of the batting positions in a batting range is provided with first agitation means and a conveyor for moving balls collected in the sump to an elevated ball distribution hopper where a second agitaton means is located. Separate gravity feed means associated with the respective pitching machines receive baseballs from said distribution hopper and act as ball magazines for corresponding pitching machines. The agitation means in the aforementioned sump and ball distribution hopper insure the smooth and rapid movement of baseballs without binding or bridging, these agitation means preferably comprising upwardly convex rotating members onto which the balls are delivered for movement in the desired direction.

It is accordingly an object of the present invention to provide an improved retrieving system for baseball batting ranges, which retrieving system is completely automatic.

It is a further object of the present invention to provide an improved retrieval system for baseball batting ranges, which system is economical in operation.

It is another object of the present invention to provide an improved retrieval system for baseball batting ranges, which system simultaneously services a plurality of pitching machines and provides for smooth and rapid automatic operation of the pitching machines.

The subject matter which I regard as my invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

DETAILED DESCRIPTION

Figure 1:
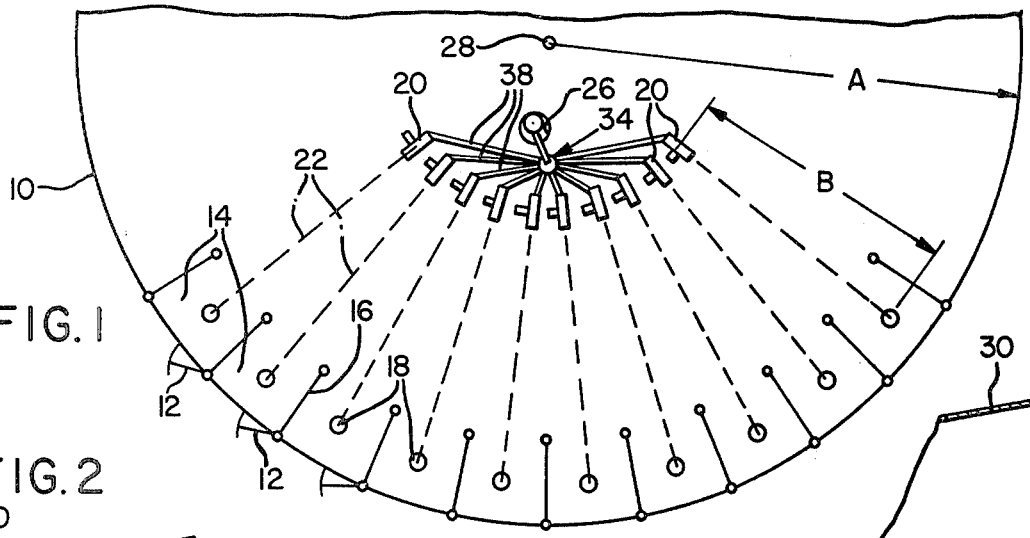
FIG. 1 is a plan view, partially broken away, of a baseball batting range according to the present invention.
Figure 2:
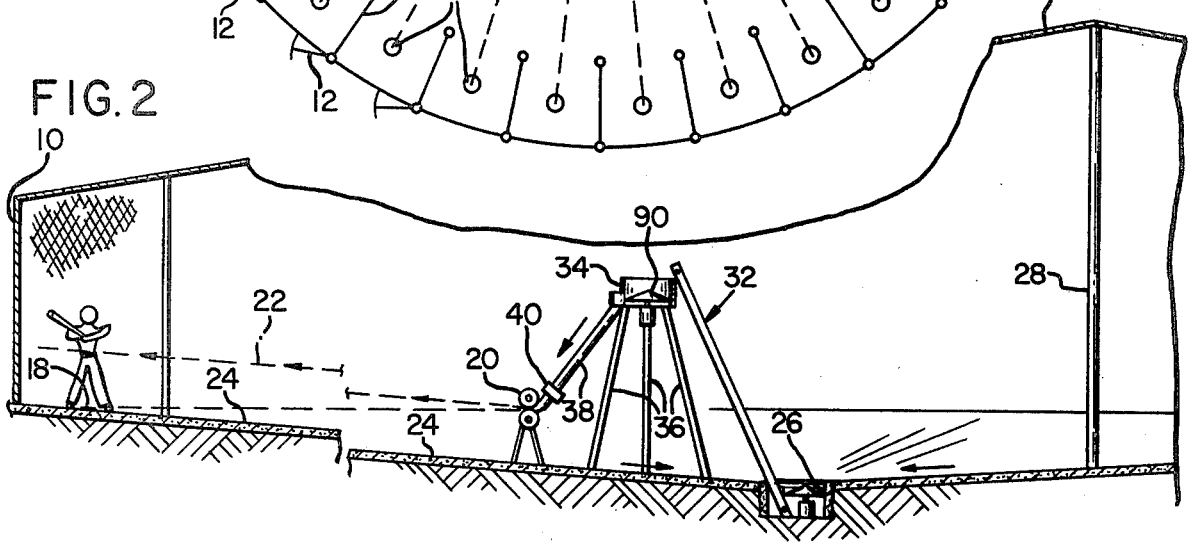
FIG. 2 is a partial cross section of the FIG. 1 batting range.

Referring to the drawings and particularly to FIGS. 1 and 2, a baseball batting range is substantially circular in construction, including a circumferential side wall 10 provided with a plurality of doors 12 along one segment of the wall leading to separate booths 14 defining a plurality of batting stations. The booths have a common back wall formed by circumferential wall 10 and radial walls 16 extending inwardly for a relatively short distance, each pair of radial walls partly enclosing a separate "home plate" 18. The booths are open forwardly toward the center of the circular structure, and between the center of the structure and the batting stations are located a plurality of separate pitching machines 20, one for each batting station. The pitching machines are adapted to pitch baseballs toward the batting stations in directions indicated by dashed lines 22 in the illustrated example. Ten batting stations are illustrated, but it is understood a greater or lesser number can be provided. In a typical instance, the radius, A, of the circular structure is approximately 90 feet while the distance B from each pitching machine to its corresponding "home plate" is 52 feet. The pitching machines are suitably of the type set forth in my copending application Ser. No. 850,472, filed Nov. 11, 1977, entitled "Ball Pitching Machine".

Referring to FIG. 2, illustrating the structure in cross section, the floor 24 thereof, suitably formed from concrete, slopes toward a cylindrical sump or well 26 which is located between the center pole 28 of the structure and the pitching machines 20. The floor of the structure slopes in all directions toward the sump. The top or roof 30 of the structure is supported by center pole 28 and need not be solid, for example it may be formed of netting or screening to insure containment of struck baseballs within the structure. After a baseball pitched by one of the machines 20 is struck by a batter, the same will eventually roll down the sloped floor toward sump 26, either from the region in front or behind the row of pitching machines, depending upon the ball's direction. A short screen or net can be placed immediately in front of the pitching machines if desired for protection thereof and having appropriate apertures through which balls are pitched.

The balls gathered in sump 26 are carried by an inclined conveyor 32 to a ball distribution hopper 34 which is elevated upon legs 36 above the level of the floor and above the level of sump 26. The ball distribution hopper is also elevated with respect to the pitching machines 20. The distribution hopper 34 is positioned immediately behind the plurality of pitching machines 20 and communicates therewith via a plurality of separate gravity feed means comprising downwardly extending tubes 38 each having an inside diameter slightly greater than the outside diameter of a baseball whereby a plurality of baseballs can be held in each tube in magazine fashion for supply to the corresponding pitching machine. A metering device 40 located proximate the lower end of each tube is selectively operated to release one ball at a time to the associated pitching machine whereby the balls can be pitched in sequence toward the corresponding batting station.

Figure 3:
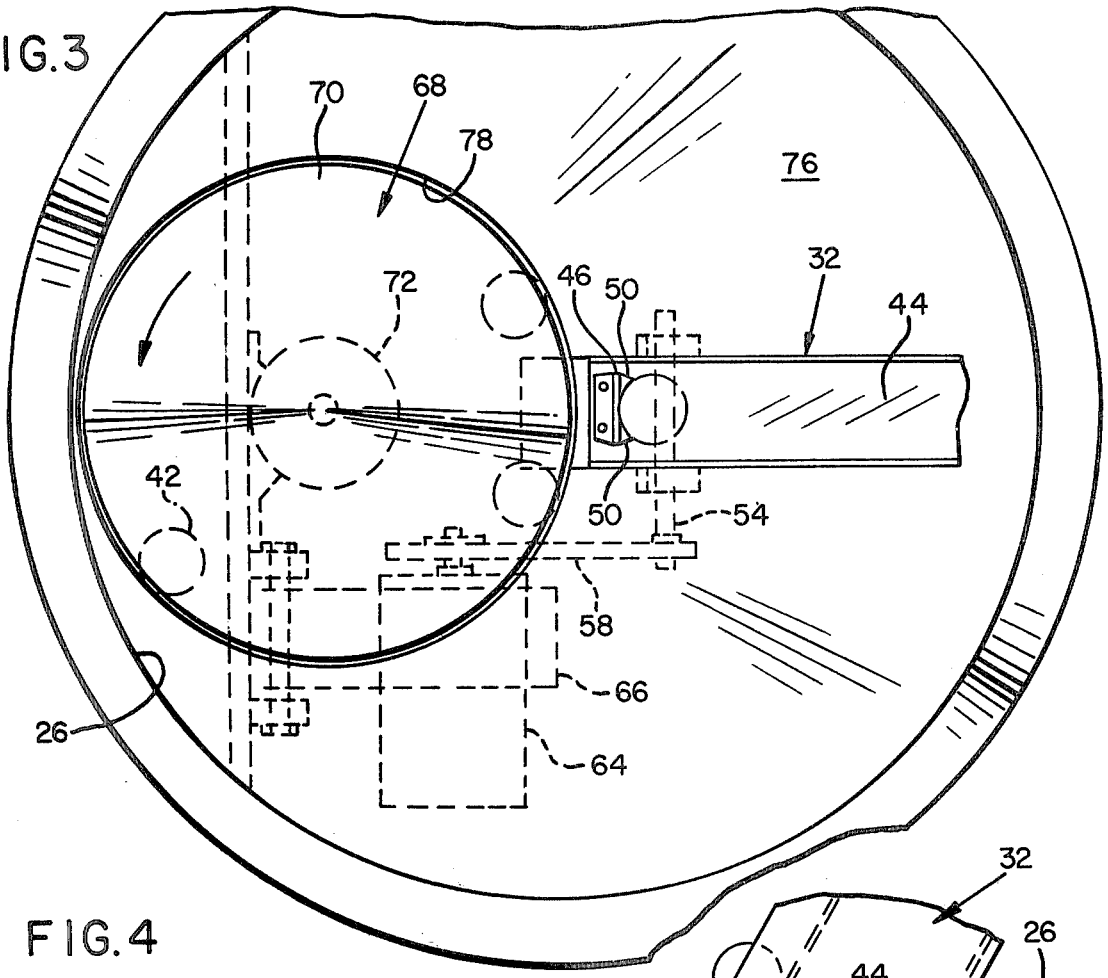
FIG. 3 is a top view, partially broken away, of a ball sump portion of the aforementioned batting range.
Figure 4:
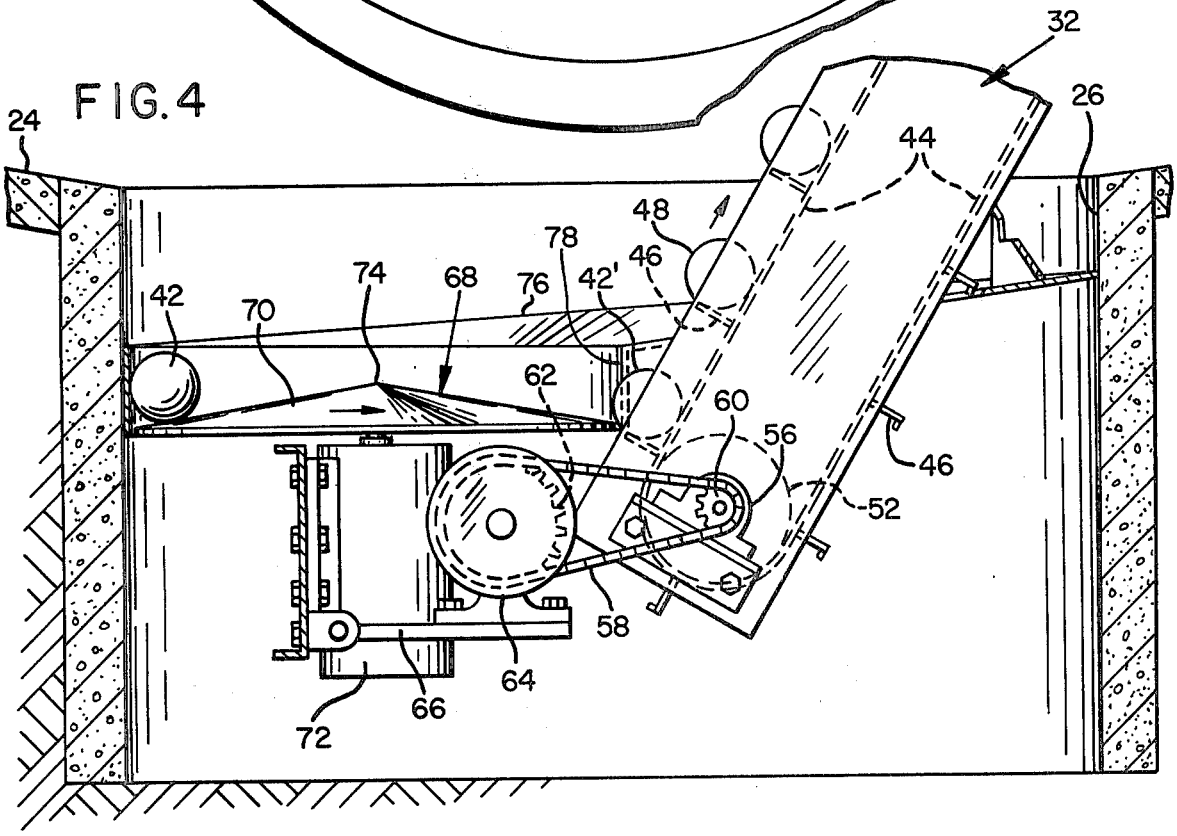
FIG. 4 is a vertical cross-sectional view of the same ball sump.

Considering sump 26 and conveyor 32 in greater detail, reference is made to FIGS. 3 and 4. The sump is suitably formed as a central well or pit having a cylindrical concrete side wall, the top edge of which is adjacent floor 24, so that balls such as ball 42 will roll into the sump. Conveyor 32 extends upwardly and angularly out of the sump from one side thereof and in the direction of distribution hopper 34. The conveyor 32 is a flight conveyor consisting of a belt 44 having metal flights 46 attached thereto as by riveting wherein each flight is shaped to accommodate a baseball 48 and move the same upwardly for delivery to the distribution hopper. Each of the flights includes a shelf extending perpendicularly from the belt and having angular tabs 50 at its forward corners which are bent upwardly in the direction of belt travel for guiding the baseball onto the flight and holding the same in place The tabs engage the ball at a slightly overcenter position as measured from the belt.

Lower belt drive pulley 52 is secured to a shaft 54 journaled in bearings 56. A drive chain 58 extends between sprocket 60 secured to shaft 54 and a sprocket 62 driven by motor 64 which is in turn supported upon a pivoting base 66 adapted to take up slack in chain 58.

The sump 26 is provided with an agitator 68 therewithin comprising an upwardly convex rotating member 70 mounted upon the shaft of a motor 72. The upwardly convex rotating member 70 is preferably in the form of a cone having the shaft of motor 72 axially located with respect thereto and in line with the apex 74 of the cone. A downwardly sloping funnel or skirt 76, suitably formed of plastic, extends from the cylindrical wall of sump 26 in surrounding relation to member 70 and concludes in a downwardly extending cylindrical portion 78 peripherally adjacent the outer circumference of member 70 with insufficient spacing remaining between member 70 and the portion 78 as would permit passage or binding of a baseball therebetween.

Agitator 68 is positioned toward one side of sump 26, opposite conveyor 32, with the periphery of member 70 being located closely adjacent the conveyor and specifically the forward edge of the flights thereof. The conveyor extends through skirt 76 with the drive mechanism of the conveyor located below the level of skirt 76. Motor 72 continuously rotates upwardly convex member 70, suitably in counterclockwise direction as viewed in FIG. 3 so the balls 42 are continually moved past and onto the flights 46 of conveyor 32. It will be appreciated the balls roll downwardly toward the outside edge of the conical member 70, and then are moved in circular fashion around the inside of cylindrical portion 78 until they reach the conveyor. Where the conveyor 32 is adjacent the periphery of the upwardly convex member 70, the balls roll downwardly onto the angularly disposed conveyor flight as illustrated for example by ball 42' in FIG. 4. The continuous rotation of member 70 not only delivers the balls successively to the conveyor, but prevents binding of the balls or bridging of a pair of balls across the conveyor opening as would prevent smooth movement of balls. Thus, the continuous rotary agitation of the balls facilitates the smooth delivery of a ball to each conveyor flight without jamming of the balls. It will be appreciated that at times a relatively few balls may be delivered to sump 26 whereby the member 70 will continuously deliver the balls to the conveyor, and at other times a large number of balls may be piled up in the sump with the member 70 continuously agitating the balls so that they do not become clogged at the entrance to the conveyor.

Figure 5:
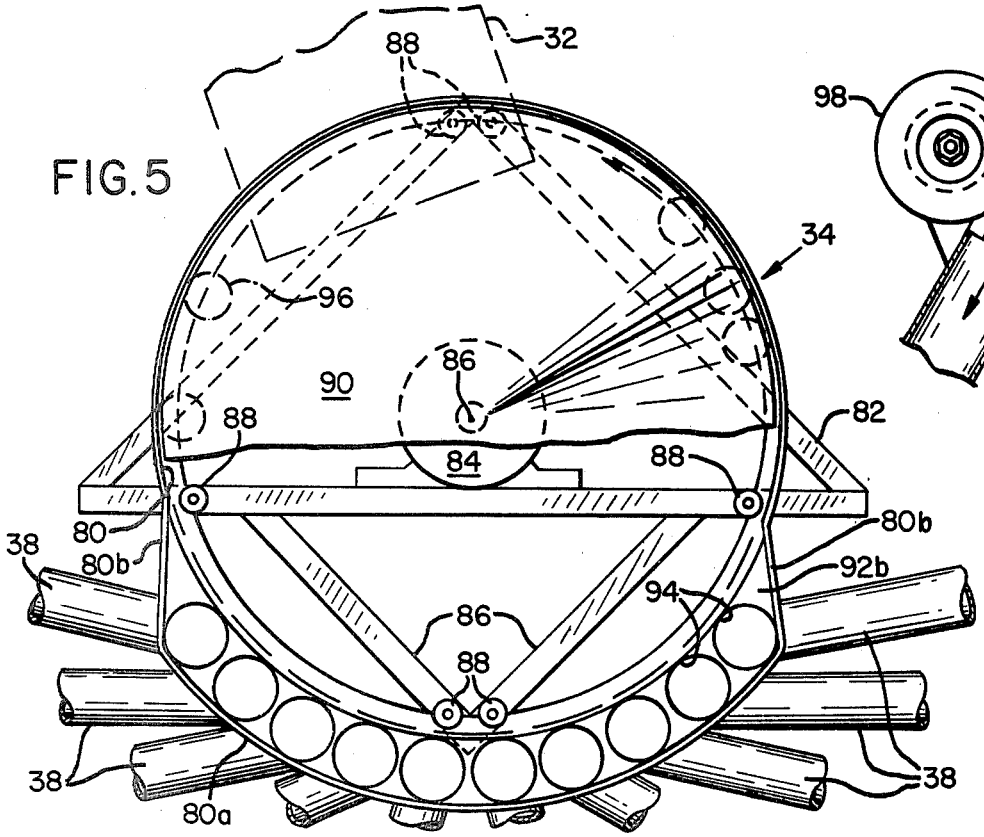
FIG. 5 is a top view, partially broken away, of a ball distribution hopper according to the present invention.

The conveyor extends upwardly at an angle of about sixty degrees to the level of ball distribution hopper 34. Referring particularly to FIG. 5, the ball distribution hopper 34 is generally cylindrical in shape, having a cylindrical side wall 80 for confining the balls delivered into the open top of the hopper via conveyor 32. Support for the hopper includes a triangular structure 82 comprised of steel angles joined in a horizontal plane and to which the legs 36 (See FIG. 2) as well as motor 84 are attached. Angular braces 86 complete a second substantially triangular configuration in the same plane for supporting the hopper structure.

A plurality of bearing wear pads 88, mounted upon structure 82 and braces 86, extend upwardly into the hopper around the inside of wall 80 for partially guiding upwardly convex rotating member 90 which is mounted on the upwardly extending shaft of motor 84. Member 90 comprises a second agitator and preferably takes the form of a cone having its axis coincident with the shaft of motor 84, so the shaft extended would coincide with the apex 86 of the cone.

Around part of the hopper, toward the location of pitching machines 20, an apron 92 extends outwardly at the peripheral level of member 90 and is provided with a number of apertures on its horizontal bottom surface, each having a diameter slightly larger than the diameter of a ball. Wall 80 extends outwardly to confine the apron area, i.e., circumferentially of the apron at **80*a* and joined by angular sections 80*b* to the remainder of wall 80. Downwardly extending tubes 38 which deliver balls to the respective pitching machines 20 are joined to the lower side of apron 92 and match apertures 94**.

Motor 84 rotates continuously in a counterclockwise direction. Thus, balls delivered to the distribution hopper 34 are carried by upwardly convex rotating member 90 toward apertures 94 in apron 92 so that the balls are delivered to the respective apertures. Generally, a relatively large number of balls are delivered into the top of distribution hopper 34 by conveyor 32 and are then delivered to the various tubes 38 such that a supply of balls normally fills or nearly fills the various tubes 38. A ball such as ball 96 rolls to the outside of member 90 and rotation of member 90 moves the ball around the periphery of the hopper for delivery to a tube 38 which has not been filled. The continuous rotation prevents jamming or clogging of the balls, e.g. when the hopper is relatively full, or when at least some of the tubes 38 are filled to the top and incoming balls need to be moved thereover to other tube openings. The binding of balls or the bridging of balls across apertures are prevented. In some instances, the conveyor 32 may deliver more balls to distribution hopper 34 than can be conveniently accommodated in the tubes 38 and in the hopper, whereby the excess balls overflow to the floor below, where they are again collected in sump 26.

The hopper 34 is located above the ball delivery height for pitching machines 20, with tubes 38 extending downwardly at an angle in the range between ten and twenty-five degrees. An angle of at least fifteen degrees is preferred to insure ready downward delivery of baseballs by gravity toward the pitching machine as the balls are metered by metering device 40.

Figure 6:
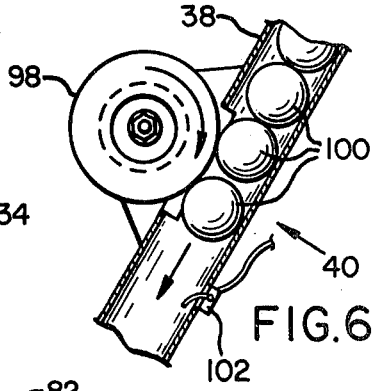
FIG. 6 is a cross-sectonal view of a ball metering device employed according to the present invention.

Referring to FIG. 6, metering device 40 positioned along a tube 38 toward the lower end thereof comprises a motor operated pinch roll 98 rotated for passing a baseball 100 downwardly along the tube 38 to deliver the same to a pitching machine. The pinch roll 98 extends partially into the tube 38 without leaving sufficient room for the passage of a baseball, such that the baseballs are normally restrained and stored in magazine fashion. However, the pinch roll is formed of soft rubber material and, when rotated, moves one ball at a times downwardly in tube 38 where the ball strikes microswitch 102 on the way to the pitching machine's counter-rotating wheels. In the baseball batting range system, the pinch roll 98 associated with a particular tube will be operated to meter a predetermined number of balls toward the associated pitching machine, as counted via microswitch 102. When the predetermined number of balls has been supplied, the metering device will be de-energized. A coin box suitably located at the corresponding batting station can be employed in a conventional manner for bringing about operation of the metering device.

While I have shown and described a preferred embodiment of my invention, it will be apparent to those skilled in the art that many changes and modifications may be made without departing from my invention in its broader aspects. I therefore intend the appended claims to cover all such changes and modifications as fall within the true spirit and scope of my invention.

I claim:

1. In a baseball batting range including a plurality of batting stations and a plurality of pitching machines located forward of and in spaced relation to corresponding batting stations for pitching balls theretoward, a ball retrieval system comprising:

a sump located forwardly of said batting stations, the floor of said baseball batting range being sloped toward said sump so that batted balls roll toward and are collected in said sump, a ball distribution hopper supported at a location elevated with respect to said sump, a conveyor extending between said sump and said ball distribution hopper for receiving balls from said sump and delivering the same to said distribution hopper, said sump being provided with first agitation means for bringing about substantially cntinuous movement of said balls in said sump and delivery of the same to said conveyor, a separate gravity feed means associated with each of said pitching machines and adapted to receive a plurality of baseballs for delivery to the corresponding pitching machine whereby a pitching machine will successively pitch the balls received from a gravity feed means, each of said separate gravity feed means being connected to said ball distribution hopper to receive balls therefrom, and second agitation means in said ball distribution hopper for providing substantialy continuous movement of the balls in said distribution hopper for substantially continuous delivery thereof to the said separate gravity feed means associated with said pitching machines.

2. The apparatus according to claim 1 wherein said first agitation means comprises an upwardly convex rotating member positioned in said sump and upon which said balls are rotated, said conveyor being positioned peripherally of said rotating member, with rotation of said member delivering balls successively to said conveyor.

3. The apparatus according to claim 2 wherein said sump is provided with a downwardly sloping skirt surrounding said rotating member except at the location of said conveyor for channeling said balls toward said rotating member and conveyor.

4. The apparatus according to claim 1 wherein said second agitator means comprises a upwardly convex rotating member onto which said balls are delivered by said conveyor, said hopper having an apron disposed peripherally around at least a portion of said rotating member which apron is provided with a plurality of openings into which balls are delivered as said member rotates, said openings communicating with said gravity feed means associated with each of said plurality of pitching machines, said ball distribution hopper having confining wall means disposed therearound.

5. The apparatus according to claim 4 wherein said gravity feed means associated with each pitching machine comprises a tube extending downwardly from said apron toward a pitching machine and communicating with one of said apron openings, said tube having an inside diameter larger than the outside diameter of said balls.

6. The apparatus according to claim 5 further including metering means positioned toward the lower end of said tube adjacent a said pitching machine for metering a predetermined number of balls into a said pitching machine.

7. The apparatus according to claim 1 wherein said conveyor comprises a flight conveyor having a plurality of flights thereupon adapted to receive and convey baseballs from said first agitator means in said sump to said distribution hopper.

8. The apparatus according to claim 1 wherein said batting range is substantially circular with said pitching machines and said sump being located centrally thereof, said batting stations being located along a segment of the periphery of said batting range.

* * * * *